United States Patent [19]

Bains

[11] 4,335,657

[45] Jun. 22, 1982

[54] AMMUNITION ROUND WITH RETAINED PISTON

[75] Inventor: William R. Bains, Lake Elsinore, Calif.

[73] Assignee: Ford Aerospace & Communications Corp., Dearborn, Mich.

[21] Appl. No.: 177,690

[22] Filed: Aug. 13, 1980

[51] Int. Cl.[3] ..... F42B 5/02

[52] U.S. Cl. ..... 102/433; 102/443

[58] Field of Search ..... 42/12, 1 L; 102/430, 102/431–433, 520–523, 443

[56] References Cited

U.S. PATENT DOCUMENTS

| | | | |
|---|---|---|---|
| 1,416,828 | 5/1922 | Holmes | 102/43 |
| 3,476,048 | 11/1969 | Barr et al. | 102/522 |
| 3,585,934 | 6/1971 | Mueller | 42/1 L |
| 4,077,147 | 3/1978 | Donnard | 42/1 L |
| 4,173,186 | 11/1979 | Dunham | 102/430 |
| 4,199,801 | 4/1980 | La Fever . | |

*Primary Examiner*—Harold J. Tudor

*Attorney, Agent, or Firm*—Peter Abolins; Clifford L. Sadler

[57] ABSTRACT

This specification discloses an ammunition round and a method of firing the ammunition round. Consecutive and reproducible firing of a primer charge and a main propellant charge is accomplished as a result of the physical movement of a divider physically separating the primer charge from the main charge. Firing of the primer charge causes movement of the divider, initiates movement of a projectile within the ammunition round, and, when the combustion gases of the primer charge are in communication with the main propellant charge, causes firing of the main propellant charge. The divider is retained within the ammunition round by a ring which limits movement of the divider.

6 Claims, 3 Drawing Figures

AMMUNITION ROUND WITH RETAINED PISTON

BACKGROUND OF THE INVENTION (1) Field of the Invention

This invention relates to an apparatus and method for improving the ballistic performance of ammunition round, and, more particularly, the firing sequence of a projectile from an ammunition round.

(2) Prior Art

Telescoped caseless ammunition is comprised of a propellant charge having an axial bore or cavity, a projectile housed entirely within the axial bore of the propellant charge and a primer positioned aft of the projectile. When a telescoped round of caseless ammunition is loaded into the chamber of a gun, the projectile, being housed in a propellant charge, is not seated in the barrel of the gun as is the projectile of a round of conventional ammunition when in a gun chamber. Upon initiation of the primer of the telescoped round, the projectile is forced forward into a barrel of the gun and becomes seated in the barrel. During the time interval from initiation of the primer until the projectile is seated in the barrel of the gun, some of the gases of combustion from the primer and from the initiated propellant charge can escape through the barrel ahead of the projectile resulting in a loss of impetus. Although telescoped ammunition is more convenient to handle than conventional ammunition, it presents different, and often more difficult, design and firing problems.

The primer must perform the dual function of first launching the projectile and then causing the main propellant charge to ignite. If the ignition of the main charge occurs too early, much of the work generated by the burning main propellant charge is lost to gases which escape down the barrel before the projectile obturates the barrel entrance. Should ignition of the main propellant charge be delayed, projectile travel causes the free volume of the chamber to be effectively increased beyond a desired optimum and reduce impetus to the projectile. Therefore, the primer must be formed in a precise, highly reproducible fashion to achieve good performance with telescoped ammunition.

Previous attempts at controlling the ignition and the firing sequence of a telescoped ammunition round have involved the use of adjusting the burning rates or chemical properties of the explosive or propellant materials. For example, it is known to use a gas barrier which separates the propellant charge into a forward section and an aft section. The chemical composition of the gas barrier is such that it momentarily delays flow of hot combustion gas to the forward section of the propellant charge, thereby delaying the ignition of the forward section with respect to the aft section.

However, relying upon the chemical properties of a material makes manufacturing more difficult and expensive because such chemical properties must be accurately controlled to provide performance of the ammunition round within desired limits. Indeed, depending upon the reproducibility required, manufacturing of such ammunition rounds can become an undesirably critical process. Further, it is difficult to develop materials which can cause firing of an ammunition round within a desired time limit under varying temperature conditions. As is known, ambient temperature affects the speed of burning and other chemical reactions.

Since ammunition may be required to perform under conditions varying from Arctic cold to desert heat, suitable reliability in chemically controlling an ignition sequence for a telescoped ammunition round has been difficult to achieve.

U.S. Pat. No. 4,197,801, entitled "Ammunition Round" and issued on Apr. 15, 1980 teaches using mechanical, rather than chemical, action to control the firing sequence of a telescoped ammunition round. As a result, there is a high degree of reproducibility of firing action over a broad range of temperatures. Further, the criticality of exactly reproducing the chemical composition of the propellants from batch to batch is reduced thus simplifying manufacture and reducing the cost of manufacture.

This application teaches a propellant charge for supplying firing power for an ammunition round having an axial cavity wherein a control tube selectively covers portions of the propellant charge facing the axial cavity thereby putting a selected portion of the propellant charge in communication with the axial cavity through a firing opening. A projectile is housed within the axial cavity and can be fired from the ammunition round. A primer is positioned generally aft of the projectile means and provides a firing force as part of a firing sequence for firing the projectile from the ammunition round. A piston seal provides a movable barrier between the primer and the propellant charge means. As a result, of the firing of the primer, the piston moves from a position blocking the firing opening through the control tube means to a position forward of the firing opening thus permitting communication from the primer means to the propellant means. However, further movement of the piston is not restricted and the piston is ejected from the ammunition round. The presence of such solid debris is particularly undesirable if the ammunition round is used aboard aircraft. The airplane may be damaged by the debris in various ways including engine failure. These are some of the problems this invention overcomes.

SUMMARY OF THE INVENTION

This invention recognizes that a piston driving a projectile within a telescope cartridge can be retained within the cartridge and have limited forward movement. That is, a stop means is positioned adjacent the piston means in order to engage the piston after a predetermined amount.

In accordance with an embodiment of this invention an ammunition round includes a propellant charge means having an axial cavity for supplying firing power for the ammunition round. A projectile means is housed within the cavity for being fired from the ammunition round. A control tube means for selectively covering portions of the propellant charge means faces the axial cavity thereby putting selected portions of the propellant charge in communication with the axial cavity and being generally positioned between the propellant charge means and the projectile means. A primer means is positioned generally aft the projectile means for providing a firing force as part of the firing sequence from the ammunition round. The control tube means includes a first firing opening for providing an access to the propellant charge means from the axial cavity so that temperature and pressure conditions within the axial cavity adjacent the first firing opening can act on the propellant charge means thus providing for firing of the propellent charge means. A piston means is positioned aft of the projectile means so that forward motion of the piston means within the axial cavity causes forward motion of the projectile means within the axial cavity, the piston means separating the axial cavity into a forward portion and an aft portion. The piston means is also conditionable between a first condition separating the primer means and the first firing opening thus providing a barrier between the primer means and the propellant means and a second condition permitting communication between the propellant means and the primer means through the firing opening. A stop ring means is coupled to the control tube means for limiting forward movement of the piston means thereby retaining the piston means within the ammunition round.

DETAILED DESCRIPTION OF THE INVENTION

Figure 1:
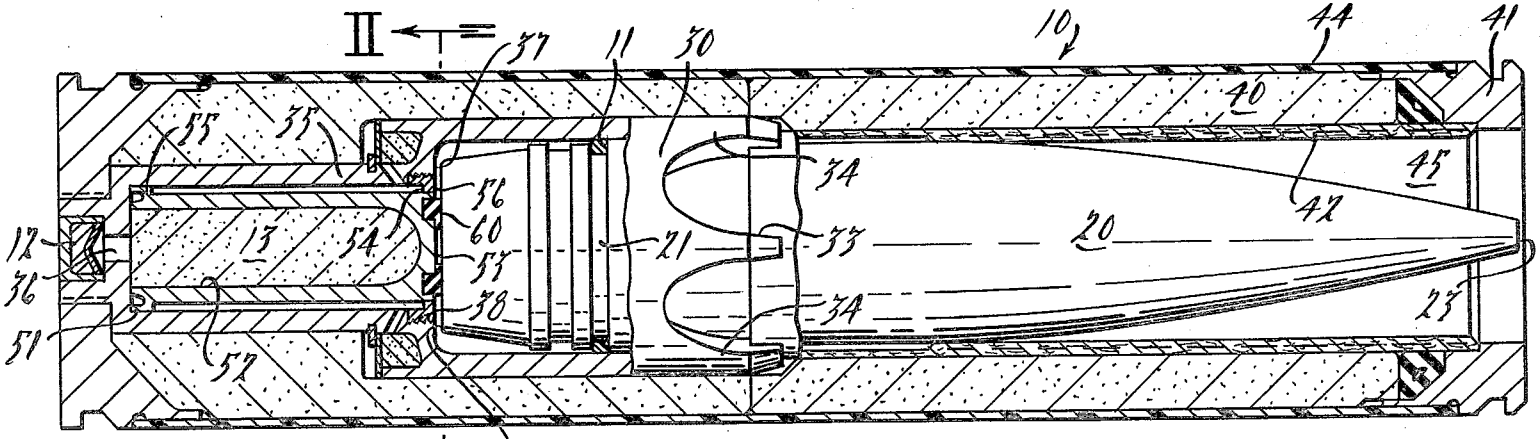
FIG. 1 is a longitudinal, partly sectional view of an ammunition round in accordance with an embodiment of this invention.

Referring to FIG. 1, an ammunition cartridge 10 includes a generally cylindrical main propellant charge 40 having a cylindrical, coaxial cavity 45 wherein is positioned a generally elongated, tapered projectile 20. Positioned aft of projectile 20 is a generally cylindrical piston 50 having a longitudinal axis aligned with the longitudinal axis of axial cavity 45. A rear access 52 is a recess in the aft face of piston 50 and contains a booster charge 13 for propelling piston 50 forward within an aft part of axial cavity 45 which also causes corresponding forward motion of projectile 20 within axial cavity 45. A primer charge 12 is positioned aft of booster charge 13 and is fired to cause firing of booster charge 13. Control tube 30 is generally cylindrical, hollow sheath which surrounds primer charge 12, booster charge 13 and a rearward poriion of projectile 20. Control tube 30 is sized to fit snuggedly within axial cavity 45 of main propellant charge 40 and has four circumferentially spaced firing openings 31 adjacent to and closed by the outside surface of piston 50. Firing of primer charge 12 and booster charge 13 causes piston 50 to move forward of firing openings 31 and expose main propellant charge 40 to firing through firing openings 31.

In accordance with an embodiment of this invention, an annular stop ring 54 is positioned within the axial cavity of control tube 30 to limit forward movement of piston 50. This retains piston 50 within ammunition cartridge 10 and nothing exits coaxial cavity 45 except projectile 20, propellant gases and whatever unburned propellant may survive. The absence of any significant solid debris exiting a gun muzzle is of great importance if the cartridge is to be used aboard aircraft. More particularly, piston 50 has its longitudinal axis aligned with the longitudinal axis of control tube 30. The innermost diameter of stop ring 54 is smaller than the interior diameter of an adjacent portion of control tube 30. Thus the inner portion of stop ring 54 extends into axial cavity 45. The outer diameter of piston 50 is sized to pass through stop ring 54. Accordingly, the outer surface of piston 50 is spaced from the interior surface of control tube 30. A rear circular flange 55 extends around an aft portion of projectile 50 and has an outer diameter substantially equal to the diameter of the adjacent portion of control tube 45. As a result, piston 50 freely slides forward until flange 50 engages stop ring 54. This engagement prevents piston 50 from following projectile 20 out of ammunition cartridge 10.

Stop ring 54 is positioned in control tube 30 at a shoulder 37. The outer circular surface of stop ring 54 is threaded to be received into a threaded recess 38 at shoulder 37. The longitudinal extent of stop ring 54 is the outer threaded side is greater than the extent of a flange or rim 56 which extends into axial cavity 45 and defines the innermost diameter of stop ring 54. A rearward face of flange 56 abuts the forward face of rear flange 55 to stop forward movement of piston 50.

Performance repeatability is achieved in this telescoped ammunition by physically separating the initial projectile acceleration and main propellant ignition function. Control tube 30 launches and guides projectile 20 toward the barrel of a firing gun and contains and confines the initial firing of primer charge 12 and booster charge 13 so that the start of the firing sequence occurs at a fixed volume thus increasing the impetus to projectile 20. After initial projectile acceleration, the ignition of main propellant charge 40 occurs through firing openings 31 when piston 50 has moved sufficiently forward within axial cavity 45 and firing openings 31 are in communication with axial cavity 45. Rear flange 55 of piston 50 is sufficiently short in an axial direction that firing openings 31 are clear of rear flange 55 when the forward face of rear flange 55 abuts stop ring 54. Thus, main propellant charge 40 fires solely as a function of the forward travel position of piston 50. If desired, ignition of main charge 40 can be achieved by positioning an igniter charge 32 between main propellant charge 40 and piston 50 at firing openings 31. Igniter charge 32 provides a positive ignition of main propellant charge 40 in response to sufficient forward travel of projectile 20 and piston 50 within axial cavity 45.

Figure 2:
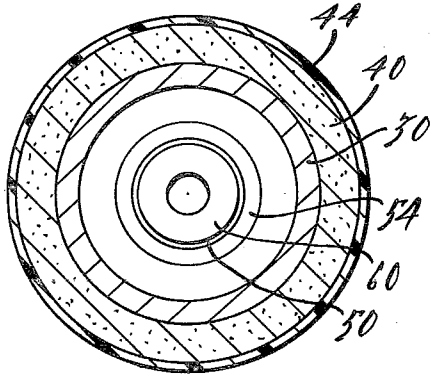
FIG. 2 is a sectional view taken along section line 2—2 of FIG. 1.

Control tube 30 has four circumferentially spaced slots 33 extending aft from the forward most portion of control tube 30 to a position forward of the rear end of projectile 20. As a result, the forward portion of control tube 30 includes forwardly projecting fingers 34 bounded on each side by slots 33 (see FIG. 1 and 2). Slots 33 are located in the wall of control tube 30 to minimize the pressure differential on the wall between main propellant charge 40 and booster charge 13 resulting from rapid pressurization of the main charge. Too great a pressure differential would cause control tube 30 to collapse and impede firing. For example, a typical steel control tube will start to buckle if the pressure differential exceeds about 4000 psi. An aluminum tube with the same geometry will collapse at around 1400 psi. A typical length of each of four slots 32 is about 0.75 inches. Another approach would be to fabricate the control tube from a frangible, combustible material. The material would have to be strong enough to support the projectile during boost and contain the main charge during initial ignition phase to assure repeatable and minimum ignition delay. Nevertheless, firing of main propellant charge 40 is done through firing openings 31 when openings 31 are unported by movement of piston 50, and is not controlled by the combustion of the control tube.

Aft of projectile 20, the interior opening of control tube 30 narrows to the diameter of piston 50 to provide a snug fit between control tube 30 and rear flange 55 of piston 50. This is desirable to prevent forward leakage of combustion gases. Radially outwardly extending flanges 35 from an exterior portion of control tube 30 adjacent firing openings 31 define a recess wherein igniter charge 32 is contained. The inner diameter of control tube 30 further narrows aft of piston 50 to provide a channel 36 connecting primer charge 12 to a booster charge 13 so that booster charge 13 can be fired as a result of control tube 30 increases to provide a cavity for receiving primer charge 12.

Piston 50 is generally cylindrical with a flat forward face 53 which is positioned adjacent a flat rear face 22 of projectile 20. Forward face 53 includes an elastomeric ring 60 to keep it firmly abutting flat rear face 22, taking out all end play which would otherwise result due to manufacturing tolerances. Rear recess 52 opens to the rear of piston 50 and extends axially forward within piston 50 toward forward face 53. Booster charge 13 is positioned within recess 52, but can also extend aft of piston 50. The rearmost portion of rear recess 52 has a slightly larger diameter than the forward most portion of recess 52 so that the rearmost wall portion of piston 50 is somewhat thinner and can form a skirt 51, which is forced radially outward when booster charge 13 fires thus sealing the outer wall of piston 50 against the inner wall of control tube 30 and preventing forward leakage of firing gases. The piston can be of many forms such as a plastic material.

Projectile 20 is generally cylindrical with a tapered front tip 23 for improved aerodynamic performance. The rearward portion of projectile 20 has an outer diameter which snuggly fits within an inner diameter of control tube 30. To further secure projectile 20 within control tube 30, the rear portion of projectile 20 includes a circumferential groove 21 wherein is positioned a split ring retainer ring 11 which compresses upon insertion into control tube 30 and provides an outwardly biased force to provide a retaining force preventing projectile 20 from slipping within control tube 30. If desired, control tube 30 can have a circumferential, inwardly facing groove to receive retainer ring 11 thus providing an additional force securing projectile 20 within control tube 30. Retainer ring 11 is advantageously fabricated of a material which shears upon application at a predetermined force.

Main propellant charge 40 is bounded by a cylindrical hollow outer case 44 on the outside cylindrical surface and an inner case 42 on the inside cylindrical surface around a forward portion of axial cavity 45. Inner case 42 extends from the front of main propellant charge 40 aft along a portion of the length of fingers 34. The aft end of main propellant charge 40 between the control tube 30 and outer case 44 is sealed by a generally annular base 14. Similarly, the forward end of main propellant charge 40 between inner case 42 and outer case 44 is closed by a generally annular front seal 41. An aft portion of main propellant charge 40 is in communication with igniter charge 32.

Having a separate piston 50 and projectile 20 facilitates the manufacture and positioning of piston 50 thus minimizing the effect of free volume variability. When designing the transverse cross section size of piston 50, it is desirable to keep it sufficient small so there is a reduction in the piston velocity at ignition and a reduction in the potential for volume variability should some ignition delay occur.

OPERATION

The firing sequence of ammunition cartridge 10 includes the firing of primer charge 12 by such means as a firing pin or an electric spark so that heat and shock waves are transmitted along channel 36 to booster charge 13 which then ignites. The sequential firing of primer charge 12 and booster charge 13 causes a pressure build up aft of piston 50. At a predetermined pressure retainer ring 11 is sheared and there is forward movement of piston 50 in a direction parallel to the axis of axial cavity 45 as guided by control tube 30. As a result of such forward movement of piston 50 there is also forward movement of projectile 20. The volume containing the combustion gases from primer charge 12 and booster charge 13 is well controlled by the action of skirt 51 sealing the volume so that hot gases do not escape forward between the outer wall of piston 50 and the inner wall of control tube 30.

Piston 50 is displaced forwardly until rear flange 55 abuts flange 56 of stop ring 54. In this location, skirt 51 and rear flange 55 are positioned forward of firing openings 31, igniter charge 32 is exposed to hot combustion gases through firing openings 31 and itself fires. For example, 0.650 inches is a typical displacement for piston 50 to expose igniter charge 32 to the flame temperature of the firing of booster charge 13. The firing sequence of ammunition cartridge 10 continues by the firing of main propellant charge 40 as a result of the firing of ignition charge 32. If there is no igniter charge 32, main propellant charge 40 fires when firing opening 31 are unported and communicate combustion gases to main propellant charge 40. Projectile 20 has a typical speed of about 175 feet per second when igniter charge 32 activates main propellant charge 40.

Projectile 20 leaves ammunition cartridge 10, it enters the barrel of a firing gun and there is a snug fit, well known in the art, between the outer surface of the projectile and the inner surface of the barrel so that the hot combustion gases caused by the firing of ammunition cartridge 10 further propel projectile 20 out of the barrel. This staged sequence of ignition provides an energetic, fast and reproducible ignition of main propellant charge 40 controlled by the precise positioning of the projectile during the initial boost phase.

Figure 3:
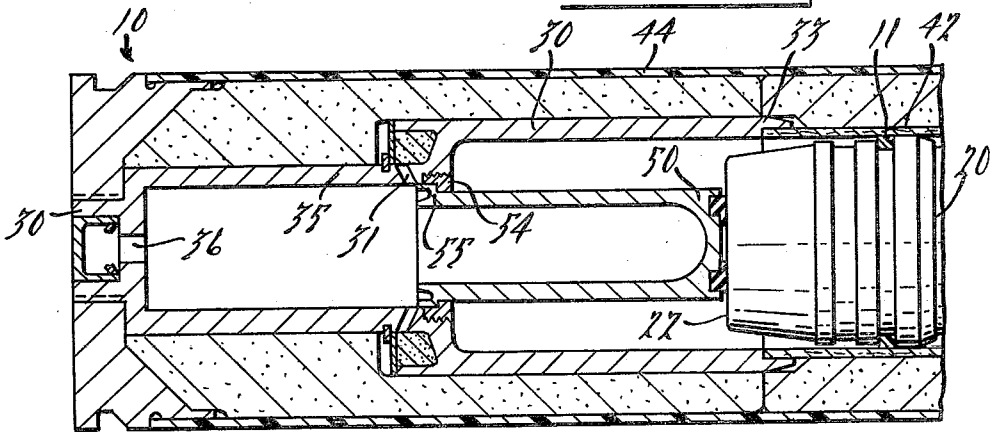
FIG. 3 is a view of the aft portion of the ammunition round of FIG. 1 after the firing sequence has begun and the piston has been moved forward sufficiently to permit communication between a main propellant charge and a primer charge, and the piston has engaged a stop ring thereby preventing ejection of the piston from the ammunition round.

Referring to FIG. 3, piston 50 as shown after firing of primer charge 12 and booster charge 13 and having moved forward sufficiently so that rear flange 55 abuts flange 56, skirt 51 and rear flange 55 are forward of firing opening 31 and firing opening 31 is exposed to the hot combustion gases within the axial cavity 45 aft of piston 50. Projectile 20 has also moved forward the same distance that piston 50 has moved forward. Retainer ring 11 has remained positioned in groove 21 of projectile 20 and has been freed of engagement with control tube 30. Rear flange 55 remains in contact with the inner surface of control tube 30 so that the combustion gases from the firing of primer charge 12 and booster charge 13 do not go into the vacated volume of axial cavity 45 aft of projectile 20. If this were to happen, the propelling force due to the firing of primer charge 12 and booster charge 13 would be diminished.

In accordance with an embodiment of this invention, projectile 20 can, for example, weigh 194.5 grams and have a diameter of 25 millimeters. The booster charge 13 can be, for example, 1.23 grams black powder, the location of firing openings 31 can be 0.75 inch from the aft end of cartridge 10, piston 50 can have a diameter of about 0.375 to 0.50 inches and a length of about 0.65 inches, igniter charge 32 can be about 1.17 grams black powder and main charge 40 can be 50 grams CIL 5554 and 60 grams IMR 4350. A typical material for inner case 42 is a canvas backed phenolic tube with a wall thickness of about 0.05. Outer tube 44 can have an outer diameter of about 1.755 inches and a length of 6.0 inches. Plastic is a typical material for outer case 44 so there is no permanent outside diameter increase due to firing pressure and the case can be easily pushed from within a straight walled chamber after firing. The control tube 30, base 14 and front seal 41 can be 17-4 stainless steel heat treated R "C" 42.

Various modifications and variations will no doubt occur to those skilled in the various arts to which this invention pertains. For example, the particular overlap of the control tube with the projectile may be varied from that disclosed herein. Similarly, the particular size and shape of the piston may be varied from that disclosed herein. These and all other variations which basically rely on the teachings through which this disclosure has advanced the art are properly considered in the scope of this invention.

I claim:

1. An ammunition round comprising:

a propellant charge means having an axial cavity for supplying firing power for said ammunition round;

a projectile means housed within said cavity for being fired from said ammunition round;

a control tube means for selectively covering portions of said propellant charge means facing said axial cavity thereby putting selected portions of said propellant charge in communication with said axial cavity and being generally positioned between said propellant charge means and said projectile means;

a primer means positioned generally aft of said projectile means for providing a firing force as part of a firing sequence from said ammunition round;

said control tube means including a first firing opening for providing an access to said propellant charge means from said axial cavity so that temperature and pressure conditions within said axial cavity adjacent said first firing opening can act on said propellant means thus providing for firing of said propellant charge means;

a piston means positioned aft of said projectile means so that forward motion of said piston means within said axial cavity causes forward motion of said projectile means within said axial cavity, said piston means separating said axial cavity into a forward portion and aft portion, and said piston means being conditionable between a first condition separating said primer means and said first firing opening thus providing a barrier between said primer means and said propellant means and a second condition permitting communication between said propellant means and said primer means through said firing opening;

said piston means having a generally cylindrical outer shape, a rearwardly opening recess means for receiving a charge and a flange means extending circumferentially around said piston means for obstructing the flow of combustion gases between said piston means and said control tube means, and for guiding said piston means within said control tube means, said flange means having a greater diameter than the remainder of said piston means so that the remainder of said piston means is spaced from said control tube means and can pass by said stop means and said flange means engages said stop means;

a stop ring means coupled to said control tube for limiting forward movement of said piston means thereby retaining said piston means within said ammunition round;

said control tube means having a threaded recess for receiving said stop means; and said stop means being a generally annular member with an external, peripheral threaded portion adapted to mate with said threaded recess, said stop means having a rim means protruding into said axial cavity and sized to pass forward travel of said piston means until said flange means abuts said rim means, the longitudinal extent of said rim means being less than the longitudinal extent of said external peripheral threaded portion.

2. An ammunition round as recited in claim 1 wherein said primer means includes a primer charge positioned aft of said piston means and a booster charge positioned within said rearwardly opening recess, said primer and booster charges being sufficiently close together so that ignition of said primer charge causes ignition of said booster charge and causes a forward movement of said piston means within said axial cavity and thus forward movement of said projectile means within said axial cavity.

3. An ammunition round as recited in claim 1 wherein said first firing opening is forward of the aft end of said piston means and forward motion of said piston means is necessary to put said propellant charge means in communication with said primer means through said first firing opening thus permitting sequential ignition of said propellant charge means and said primer means as a function of the physical position of said piston means within said axial cavity, the longitudinal extent of said flange means being sufficiently short so that said flange means can abut said stop means and said firing openings be positioned aft of said flange means.

4. An ammunition round as recited in claim 3 wherein said control tube means is sufficiently axially elongated so that it can circumferentially surround, in a direction transverse to the longitudinal axis of said axial cavity, said primer means, said piston means and at least a portion of said projectile means.

5. An ammunition round comprising:

a propellant charge having an axial cavity for supplying firing power for said ammunition round;

a projectile means housed within said cavity for being fired from said ammunition round, said projectile means being elongated in a direction along the axis of said axial cavity;

a primer means positioned generally aft of said projectile means for providing a firing force as part of a firing sequence for firing said projectile means from said ammunition round;

a piston means positioned aft of said projectile means so that forward motion of said piston means within said axial cavity causes forward motion of said projectile means within said axial cavity and said piston means includes a circumferential, radially extending flange thereby providing a seal isolating the portion of said axial cavity forward of said flange from the portion of said axial cavity aft of said flange, said flange acting as a seal so a force caused by firing of said primer means is transferred to said piston means thus causing forward motion, and said piston means further including a rearwardly opening recess so that said flange generally surrounds the periphery of said recess, said flange having a greater diameter than the remainder of said piston means;

a primer charge portion of said primer means being positioned aft of said piston means and a booster charge portion of said primer means being positioned within said recess and being positioned sufficiently close so that firing of said primer charge portion causes firing of said booster charge portion and results in forward motion of said piston means and projectile means;

a control tube means positioned with said axial cavity and laterally surrounding said primer means and said piston means thereby directing a force from the firing of said primer means along the axis of said axial cavity, said control tube means having a first firing opening extending radially through the wall of said control tube means thereby providing a path of communication between said axial cavity and said propellant charge, said first firing opening being positioned forward of said flange so that said first firing opening is initially isolated from said primer means by said piston means and is in communication with said primer means after firing of said primer means and movement of said flange forward of said first firing opening thus causing firing of said piston means along said axial cavity, said control tube means having a shoulder where a portion of lesser diameter surrounds said piston means and a portion of greater diameter surrounds said projectile means and said shoulder including a threaded recess; and a stop ring means having a generally annular shape with an external threaded peripheral portion sized to fit within said threaded recess and with an inwardly extending rim of a diameter for passing all of said piston means except said flange thereby limiting forward motion of said piston means, said threaded peripheral portion having a greater longitudinal length than said rim.

6. An ammunition round as recited in claim 5 wherein said coupling means includes an inwardly facing circumferential groove within said control tube means, an outwardly facing circumferential groove around said projectile means, said grooves positioned to be aligned when said control tube means and said projectile means are in said ammunition round, and a retainer ring adapted to be positioned within said inwardly and outwardly facing grooves and to shear in response to a predetermined pressure applied to said projectile means thereby releasably securing said projectile means and said piston means to each other.

* * * * *